US006336383B1

(12) United States Patent
Hung

(10) Patent No.: US 6,336,383 B1
(45) Date of Patent: Jan. 8, 2002

(54) WRENCH STRUCTURE

(76) Inventor: Kun Chih Hung, No. 56, Hsin Jen 3rd Street, Ta-Li City, Taichung Hsien (TW)

( * ) Notice: Subject to any disclaimer, the term of this patent is extended or adjusted under 35 U.S.C. 154(b) by 0 days.

(21) Appl. No.: 09/769,480

(22) Filed: Jan. 26, 2001

(51) Int. Cl.[7] ..... B25B 13/46
(52) U.S. Cl. ..... 81/60; 81/177.9; 81/177.2
(58) Field of Search ..... 81/60, 177.2, 177.7, 81/177.8, 177.9

(56) References Cited

U.S. PATENT DOCUMENTS 1,380,643 A * 6/1921 Eagle ..... 81/177.7
2,886,998 A * 5/1959 Scott ..... 81/177.9
3,023,652 A * 3/1962 Feldman ..... 81/60
3,186,265 A * 6/1965 Wenturine et al. ..... 81/177.9
3,839,929 A * 10/1974 Richards ..... 81/177.7
5,996,448 A * 12/1999 Suekage ..... 81/177.2
6,000,299 A * 12/1999 Cole ..... 81/60
6,101,907 A * 8/2000 McGovern et al. ..... 81/177.8
6,138,533 A * 10/2000 Turtle ..... 81/177.2
6,216,567 B1 * 4/2001 Hu ..... 81/177.9
6,220,125 B1 * 4/2001 Lan ..... 81/177.9
6,247,386 B1 * 6/2001 Gummow ..... 81/177.8

* cited by examiner

*Primary Examiner*—James G. Smith
*Assistant Examiner*—Hadi Shakeri
(74) *Attorney, Agent, or Firm*—Rosenberg, Klein & Lee

(57) ABSTRACT

A wrench structure including a main body, a pivot block pivotally connected with the main body, a projecting block pivotally connected with the pivot block and a grip pivotally connected with the projecting block. A first engaging mechanism is provided between the pivot block and the main body. A locating unit is disposed between the projecting block and the pivot block. A second engaging mechanism is disposed between the grip and the pivot block. The first engaging mechanism serves to control the main body to be engaged with the pivot block and located at different angles from the pivot block. The locating unit serves to control the projecting block to engage with or disengage from pivot block to be free to rotate. After the grip is pivotally rotated to contain different angles with the pivot block, the second engaging mechanism serves to locate and fix the grip with the pivot block. Accordingly, the wrench is bendable about multiple axes to have various configurations for easy use in different limited space conditions.

5 Claims, 4 Drawing Sheets

WRENCH STRUCTURE

BACKGROUND OF THE INVENTION

The present invention is related to an improved wrench structure in which a main body, a pivot block, a projecting block and a grip are pivotally connected with each other, enabling the wrench to be bent about multiple axis to have various configurations for easy use in different limited space conditions.

FIG. 7 shows a conventional wrench having a head section 81 in which a ratchet mechanism 9 is disposed. The head section 81 is pivotally connected with a thread section 83 of a grip 82. A thread bush 84 is screwed on the thread section 83. One end of the head section 81 adjacent to the grip 82 is formed with three engaging faces 811, 812, 813 with different angles. After the thread bush 84 is tightened, the thread bush 84 is engaged with any of the engaging faces 811, 812, 813, whereby the head section 81 can be located at three different bending angles.

According to the above structure, each time the angle of the grip 82 is adjusted, it is necessary to untighten and tighten the thread bush 84. Such procedure is quite troublesome. Furthermore, the grip 82 and the head section 81 are only provided with one bendable pivot section so that the wrench still cannot be conveniently used.

SUMMARY OF THE INVENTION

It is therefore a primary object of the present invention to provide an improved wrench structure in which a main body, a pivot block, a projecting block and a grip are pivotally connected with each other. A first engaging mechanism is provided to control the main body to be engaged with the pivot block and located at different angles from the pivot block. A locating unit is provided to control the projecting block to engage with or disengage from pivot block to be free to rotate. After the grip is pivotally rotated to contain different angles with the pivot block, a second engaging mechanism serves to locate and fix the grip with the pivot block. Accordingly, the wrench is bendable about multiple axes to have various configurations for easy use in different limited space conditions.

The present invention can be best understood through the following description and accompanying drawings wherein:

DETAILED DESCRIPTION OF THE PREFERRED EMBODIMENTS

Figure 1:
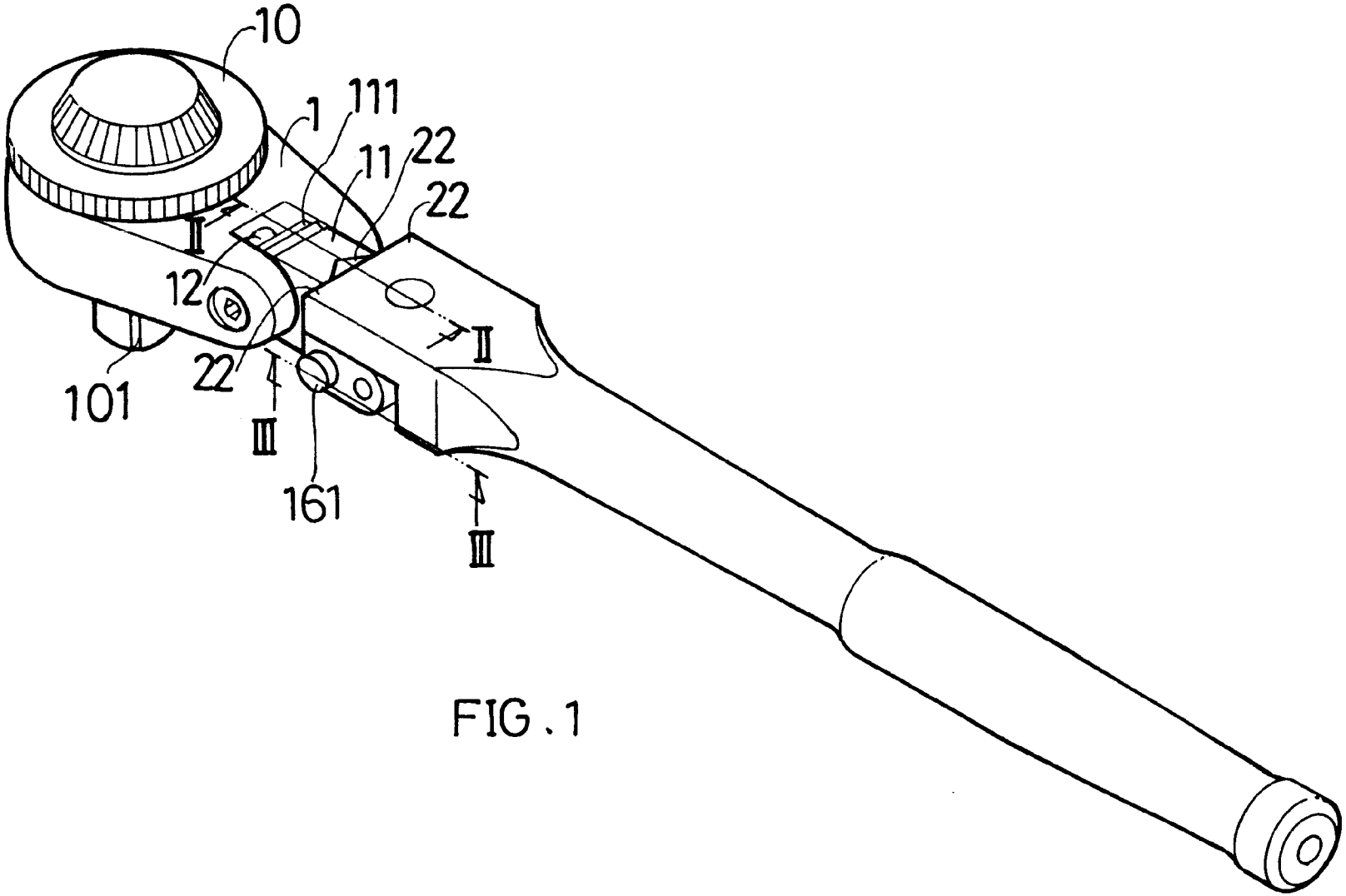
FIG. 1 is a perspective assembled view of the wrench of the present invention.
Figure 2:
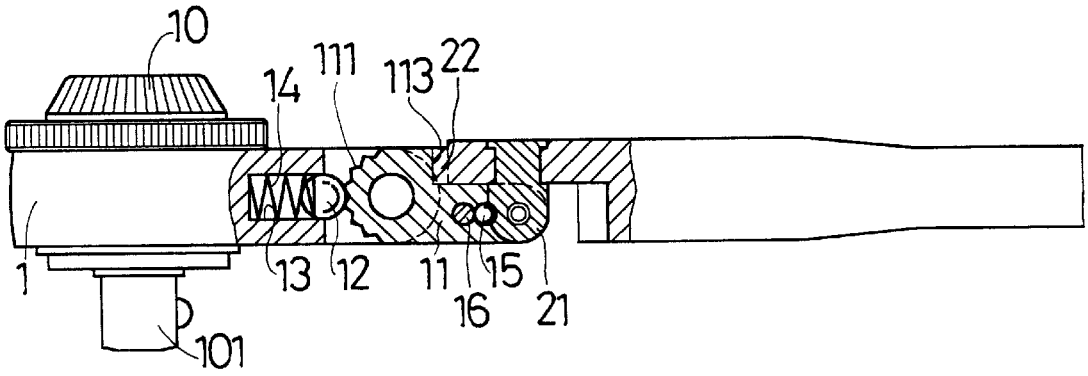
FIG. 2 is a sectional view taken along line II—II of FIG. 1.
Figure 3:
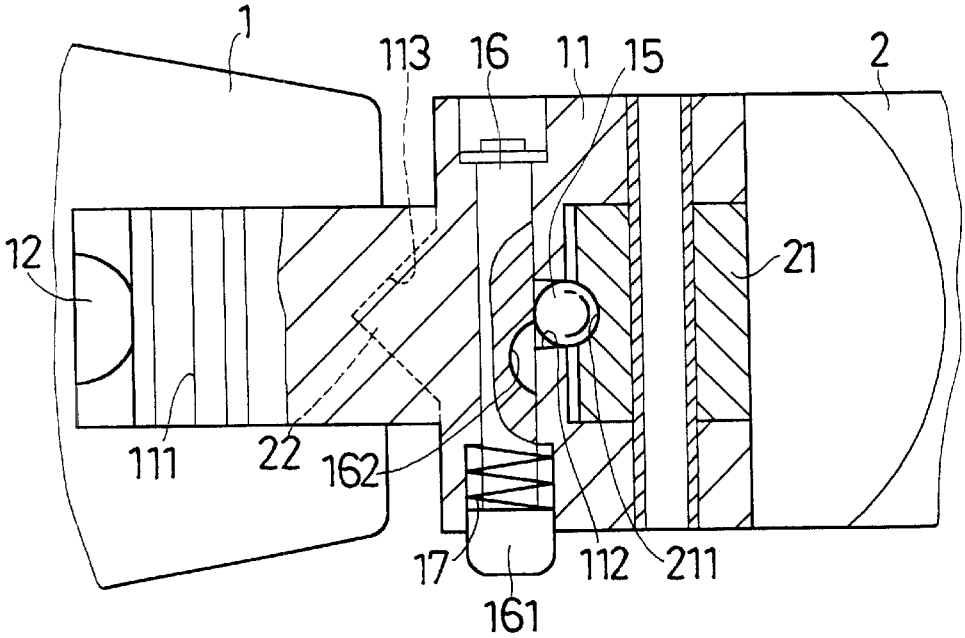
FIG. 3 is a sectional view taken along line III—III of FIG. 1.

Please refer to FIGS. 1 to 6. The wrench structure of the present invention includes:

a main body 1 provided with a ratchet mechanism 10 having a tool connecting section 101 projecting from the main body 1;

a pivot block 11 pivotally connected with the main body 1, a first steel ball 12 being positioned between the pivot block 11 and the main body 1, the first steel ball 12 being disposed in a cavity 13 of the main body 1, a first spring 14 being disposed in the cavity 13, the pivot block 11 being formed with multiple teeth 111 corresponding to the first steel ball 12, the first spring 14 serving to resiliently push the first steel ball 12 to engage between the teeth 111 of the pivot block 11, whereby the main body 1 can be rotated and located on the pivot block 11 at different angles;

a projecting block 21 pivotally connected with the pivot block 11, the pivot block 11 being formed with a dent 112 adjacent to the projecting block 21, a second steel ball 15 being disposed in the dent 112, the projecting block 21 being formed with a first recess 211 corresponding to the second steel ball 15, a movable bolt 16 being fitted in the pivot block 11, the bolt 16 having a stop block 161, a second spring 17 being fitted on the bolt 16 between the stop block 161 and the pivot block 11, the second spring 17 serving to resiliently push the bolt 16 to press the second steel ball 15 to engage and locate in the first recess 211 of the projecting block 21, the bolt 16 having a second recess 162, when the bolt 16 is moved to aim the second recess 162 at the second steel ball 15, the second steel ball 15 is retracted into the second recess 162 and disengaged from the first recess 211 of the projecting block 21, whereby the pivot block 11 can be pivotally rotated relative to the projecting block 21; and a grip 2 pivotally connected with the projecting block 21. When the projecting block 21 is located on the pivot block 11, the grip 2 is adjacent to the pivot block 11. The pivot block 11 is formed with a locating notch 113. The grip 2 is formed with multiple projecting sections 22 corresponding to the locating notch 113. The grip 2 and the projecting block 21 can be pivotally rotated to contain different angles with the pivot block 11. Thereafter, the projecting section 22 is engaged in the locating notch 113 to locate the grip 2.

Figure 4:
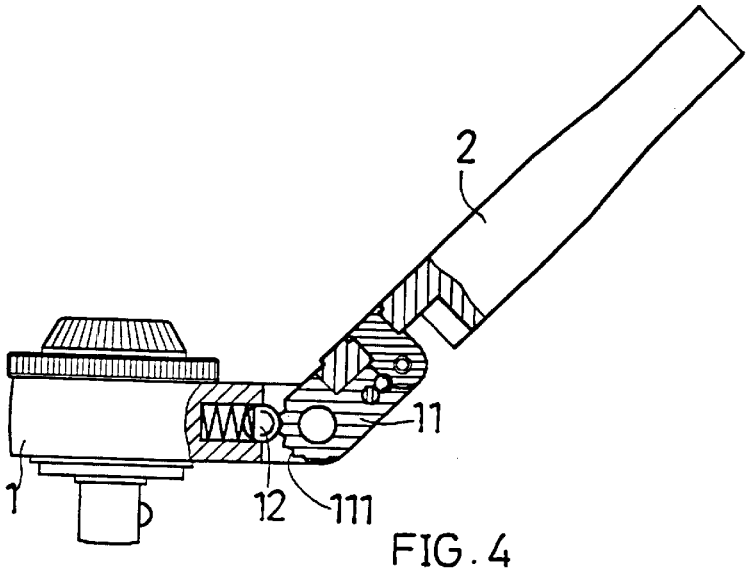
FIG. 4 is a sectional view showing the use of the wrench of the present invention in one state.

In use of the wrench, the angle can be adjusted according to actual need as follows:

1. The bending angle between the main body 1 and the pivot block 11 can be adjusted by pivotally rotating the main body I as shown in FIG. 4;
2. The pivot block 11 can be fixed with the projecting block 21 or freely pivotally rotated relative to the projecting block 21.
3. The projecting block 21 and the grip 2 are pivotally rotated to contain different angles with the pivot block 11.

Figure 5:
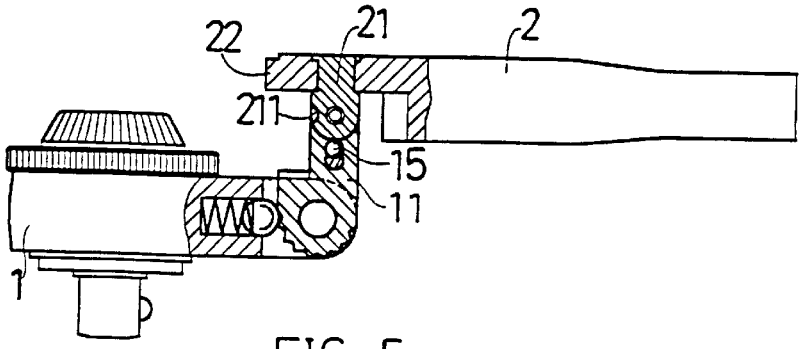
FIG. 5 is a sectional view showing the use of the wrench of the present invention in another state.

When adjusting the angle, any of the above adjustments or a combination of two of the above adjustments can be performed. Therefore, the wrench of the present invention can be more widely and conveniently used in different working sites having limited space. For example, as shown in FIG. 5, a user can adjust the main body 1 to contain a 90 degree angle with the pivot block 11. Then the projecting block 21 and pivot block 11 are adjusted and freely pivotally rotated to make the projecting section 22 of the grip 2 disengaged from the locating notch 113 of the pivot block 11. At this time, the grip 2 can be freely pivotally rotated relative to the projecting block 21. Accordingly, a vertical drop exists between the main body 1 and the grip 2 so that the wrench can be used in a working site necessitating such vertical drop. The user can push the grip 2 back and forth so as to continuously wrench the main body 1.

Figure 6:
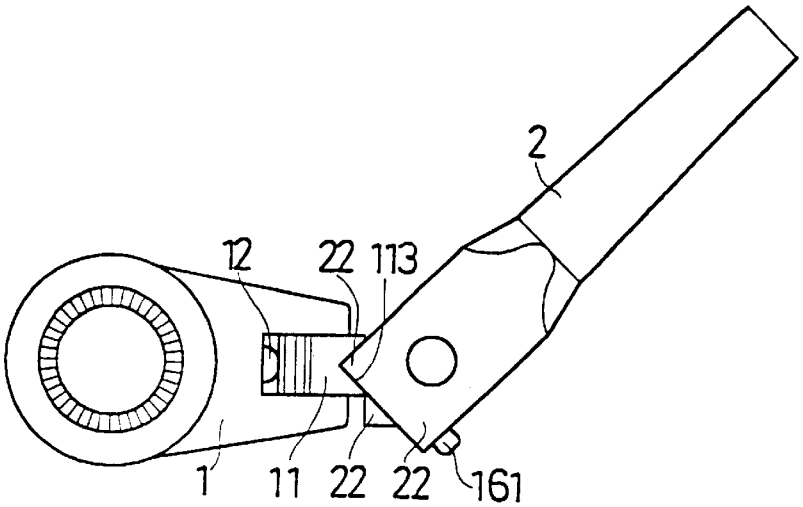
FIG. 6 is a sectional view showing the use of the wrench of the present invention in still another state.
Figure 7:
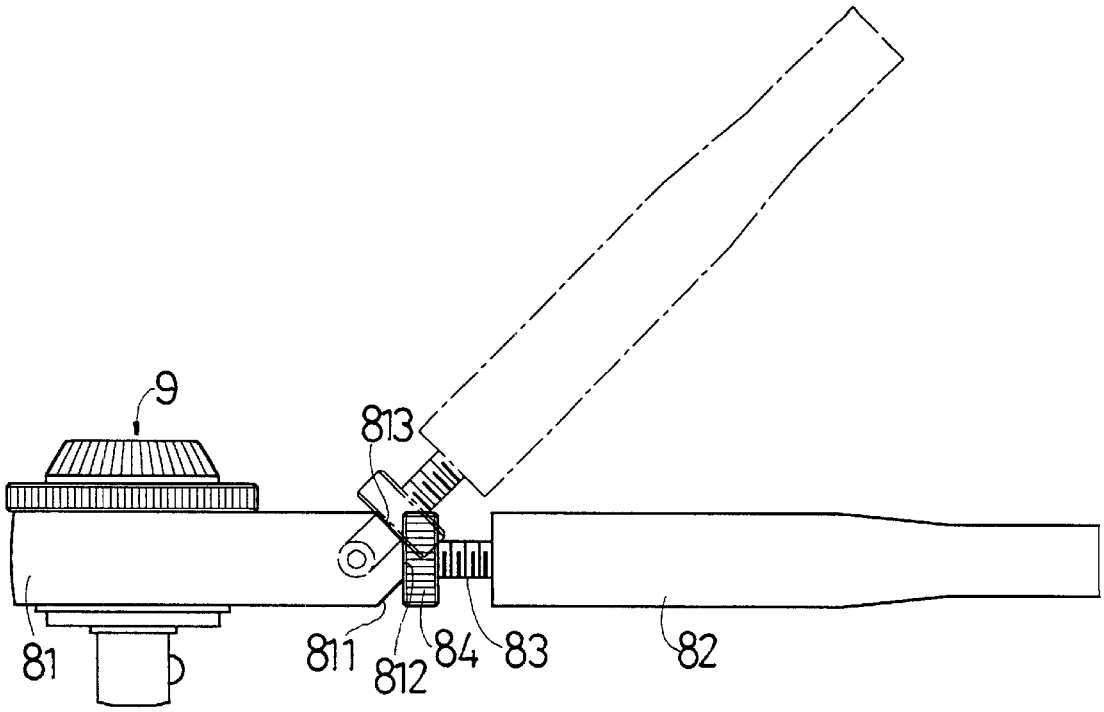
FIG. 7 PRIOR ART
FIG. 7 shows a conventional wrench.

Further for example, as shown in FIG. 6, the user can press down the stop block 16 of the bolt 16 to aim the second recess 162 at the second steel ball 15. At this time, the second steel ball 15 is retracted into the second recess 162 and disengaged from the first recess 211 of the projecting block 21, whereby the pivot block 11 can be pivotally rotated relative to the projecting block 2. Then the grip 2 is rotated, whereby the grip 2 and the pivot block 11 contain an angle. The projecting section 22 is engaged in the locating notch 113 and the second steel ball 15 is engaged in the first recess 211 of the projecting block 21. Accordingly, the pivot block 11, projecting block 21 and the grip 2 are fixed with each other. Under such circumstance, the main body 1 and the grip 2 horizontally contain an angle and can be used in a working site specifically necessitating such angle.

In conclusion, the main body 1, pivot block 11, projecting block 21 and the grip 2 are pivotally connected with each other. The first steel ball 12 in the main body 1 is engaged with the teeth 111 of the pivot block 11 to controllably locate the main body 1 at different angles from the pivot block 11. The bolt 16 serves to control the second steel ball 15 to engage in or disengage from the first recess 211 of the projecting block 21, whereby the projecting block 21 is fixed with the pivot block 11 or free to rotate. Any of the projecting sections 22 of the grip 2 can be engaged in the locating notch 113 of the pivot block 11, whereby after the projecting block 21 and the grip 2 are pivotally rotated to contain different angles with the pivot block 11, the grip 2,is located. Accordingly, the wrench of the present invention is bendable about multiple axes to have various configurations for easy use in different limited space conditions.

The above embodiments are only used to illustrate the present invention, not intended to limit the scope thereof. Many modifications of the above embodiments can be made without departing from the spirit of the present invention.

What is claimed is:

1. A wrench structure comprising:

a main body provided with a ratchet mechanism having a tool connecting section projecting from the main body;

a pivot block pivotally connected with the main body, a first engaging mechanism being provided between the pivot block and the main body, whereby the main body and the pivot block can be rotated and located at different angles;

a projecting block pivotally connected with one end of the pivot block opposite to the main body, a locating unit being disposed between the projecting block and the pivot block, whereby the projecting block can be fixed with the pivot block or pivotally rotated relative to the pivot block; and a grip pivotally connected with the projecting block, a second engaging mechanism being disposed between the grip and the pivot block, whereby after the grip and the projecting block can be pivotally rotated to contain different angles with the pivot block, the grip is fixed with the pivot block and located.

2. A wrench structure as claimed in claim 1, wherein the first engaging mechanism includes a first steel ball disposed in a cavity of the main body; a resilient member being disposed in the cavity, the pivot block being formed with multiple teeth corresponding to the first steel ball, the resilient member serving to resiliently push the first steel ball to engage between the teeth of the pivot block, whereby the main body and the pivot block can be rotated and located at different angles.

3. A wrench structure as claimed in claim 1, wherein the locating unit includes a second steel ball disposed in a dent of the pivot block, the projecting block being formed with a first recess corresponding to the second steel ball, a movable bolt being fitted in the pivot block, in normal state, the bolt pushing the second steel ball to engage and locate in the first recess of the projecting block, the bolt having a second recess, when the bolt is moved to aim the second recess at the second steel ball, the second steel ball is retracted into the second recess and disengaged from the first recess of the projecting block, whereby the pivot block can be pivotally rotated relative to the projecting block.

4. A wrench structure as claimed in claim 1, wherein the second engaging mechanism includes a locating notch formed on the pivot block, the grip being formed with multiple projecting sections corresponding to the locating notch, whereby the grip and the projecting block can be pivotally rotated to contain different angles with the pivot block and then one of the projecting sections is engaged in the locating notch to fix the grip with the pivot block.

5. A wrench structure as claimed in claim 3, wherein the bolt has a stop block, a spring being fitted on the bolt between the stop block and the pivot block, in normal state, the spring serving to resiliently push the bolt to prevent the second recess from being aimed at the second steel ball.

* * * * *